US007048468B2

(12) United States Patent
Fuchs

(10) Patent No.: US 7,048,468 B2
(45) Date of Patent: May 23, 2006

(54) COVER ARRANGEMENT

(75) Inventor: Alfred Fuchs, Hahnstatten (DE)

(73) Assignee: ACO Serverin Ahlmann GmbH & Co. KG, Rendsburg (DE)

( * ) Notice: Subject to any disclaimer, the term of this patent is extended or adjusted under 35 U.S.C. 154(b) by 0 days.

(21) Appl. No.: 10/489,845

(22) PCT Filed: Sep. 18, 2002

(86) PCT No.: PCT/EP02/10482

§ 371 (c)(1),
(2), (4) Date: Mar. 16, 2004

(87) PCT Pub. No.: WO03/027400

PCT Pub. Date: Apr. 3, 2003

(65) Prior Publication Data

US 2004/0247389 A1 Dec. 9, 2004

(30) Foreign Application Priority Data

Sep. 21, 2001 (DE) ..... 101 46 520
Oct. 18, 2001 (DE) ..... 101 51 449

(51) Int. Cl.
*E02D 29/14* (2006.01)

(52) U.S. Cl. ..... 404/25

(58) Field of Classification Search ..... 404/25; 52/19, 20; 220/3.8
See application file for complete search history.

(56) References Cited

U.S. PATENT DOCUMENTS

| | | | | | |
|---|---|---|---|---|---|
| 724,635 | A | * | 4/1903 | Weller | 70/423 |
| 4,508,469 | A | * | 4/1985 | Dumortier | 404/25 |
| 4,840,514 | A | * | 6/1989 | Defrance et al. | 404/25 |
| 5,017,039 | A | * | 5/1991 | Spiess et al. | 404/25 |
| 5,123,776 | A | * | 6/1992 | Lang et al. | 404/25 |
| 5,160,213 | A | * | 11/1992 | Spiess et al. | 404/25 |
| 5,340,232 | A | * | 8/1994 | Spiess et al. | 404/25 |

FOREIGN PATENT DOCUMENTS

| | | | |
|---|---|---|---|
| DE | 0 533 533 | * | 9/1992 |
| DE | 690 00 391 T2 | | 3/1993 |
| EP | 1 154 080 | | 11/2001 |
| FR | 2 715 690 | | 8/1995 |
| FR | 2 788 070 | | 7/2000 |
| FR | 2 805 292 | | 8/2001 |
| GB | 1 536 214 | | 12/1978 |
| GB | 2 355 038 | | 4/2001 |

* cited by examiner

*Primary Examiner*—Gary S. Hartmann
(74) *Attorney, Agent, or Firm*—Merchant & Gould P.C.

(57) ABSTRACT

A cover arrangement is disclosed for a channel arrangement, a drainage channel, cable channel, shaft or similar hollow body that can be installed in the ground and opened, with a cover that can be set onto a bearing surface of a frame and is coupled to the frame so as to be pivotable about an axis of rotation, such that the cover can be tilted toward two sides without the use of tools, through the use of two oppositely disposed hinges comprising two rotation/fixation devices.

18 Claims, 3 Drawing Sheets

COVER ARRANGEMENT

RELATED U.S. APPLICATIONS

This application is a 371 of corresponding PCT application No. PCT/EP02/10482 filed Sep. 18, 2002 and designating the U.S.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention relates to a cover arrangement for a channel arrangement, according to the precharacterizing clause of claim 1.

BACKGROUND OF THE INVENTION

Channels are known, in particular drainage channels with covers, in which the cover is set onto a bearing surface of the frame and is held there by screws, latches or similar devices. To do work within the channels, such as cleaning them, the cover must previously be raised and set down elsewhere. This requires a great deal of force and is also time-consuming.

A substantial disadvantage of this known arrangement consists on one hand in the expense involved in manufacturing and installing it, and on the other hand in the time taken to release and re-insert the screws.

Channel devices are also known in which hinges are provided, the leaves of which are connected to the frame and the cover, and which allow the cover to be pivoted to one side. A substantial disadvantage of this known channel device is that the cover cannot be detached from the frame, and hence cannot be removed. Another disadvantage associated with the use of hinges is that hinges require a great deal of maintenance. In particular when a channel is being used for the drainage of surface water, they will inevitably become dirty and corroded to an extent that their function is impaired, and the hinge region may even become fractured.

To avoid accidents, covers installed on streets or other places over which motor vehicles are driven should always be tilted in such a way that when struck by a vehicle, the cover closes by moving out of the tilted position in the direction in which the vehicle is travelling. If a known channel device is installed in the ground in such a way that tilting in this direction is impossible—that is, the arrangement has been wrongly installed—in order to satisfy this safety criterion the channel device must be taken out of the ground and put back correctly. Removal and re-installation of the channel device is extremely costly, in both money and time.

For installations in places with a steep longitudinal gradient, the hinges should be arranged such that it is possible to tilt the cover in the direction of the gradient. However, if the hinges are arranged in such a way that the cover can only be tilted against the direction of the gradient, the tilt angle of the cover will be reduced by an amount equal to the angle of the gradient. This means that the angle between the cover and the horizontal makes it more likely that cover will close in an uncontrolled manner, for instance as a result of a gust of wind or vibration. Uncontrolled closing of the cover presents a major risk of injury.

It is extremely disadvantageous when channel devices in which the hinges are so disposed that the cover cannot be tilted in the gradient direction must be laboriously and expensively dug up and installed anew, or else expensive devices must be provided to prevent uncontrolled closing of the cover.

BRIEF SUMMARY OF THE INVENTION

It is thus the object of the invention to provide a cover arrangement which has been developed in such a way that the safety of the arrangement during use is enhanced in a simple manner.

This object is achieved by a cover arrangement according to claim 1.

It is a fundamental aim of the invention that the cover can be pivoted toward two sides without the use of a tool, by means of hinge means comprising two rotation and fixation devices, which are disposed opposite one another. As a result, the cover of a fixedly installed channel arrangement can be pivoted toward whichever side the user desires.

The hinge means are preferably so constructed that the cover can be lifted up in a direction perpendicular to the frame, without being tilted with respect to the frame, and during lifting the fixation/rotation devices become disengaged. Thus in addition to tilting or pivoting, the user also has the option of removing the cover completely.

Preferably the device for rotation and fixation—in analogy to a conventional hinge—comprises a pivot element and a pivot peg. The pivot element is fixedly attached to the cover and bent downward in a hook shape. The pivot peg is fixedly attached to the frame and shaped so as to correspond to the pivot element, so that the pivot element can be rotated about the pivot peg. The pivot peg is so disposed in relation to the axis of rotation that the pivot element can be lifted away from the pivot peg when the cover is completely closed. Hence when the cover is lifted up as described above, the hook-shaped pivot elements of all hinge means simultaneously become disengaged from the pivot pegs.

Preferably each of the devices for rotation and fixation comprises a guide bar that is fixedly attached to the frame. The pivot peg is so disposed that as the cover is being rotated, the hook-shaped pivot element is guided in a form-fitting manner between the pivot peg and the guide bar.

Preferably the rotation and fixation devices are so constructed that when the cover has been rotated to a predetermined angle, a bearing surface on a cover foot is lifted up from a bearing surface on the frame. For this purpose the guide bar and the peg are constructed and disposed such that as the cover rotates when raised on the side opposite the pivot element concerned, when the cover reaches a first tilt angle of preferably 10–20° a downwardly bent end of the pivot element comes into contact with the surface of the guide bar. It proves to be extremely advantageous that, because of this arrangement, the cover is prevented from sinking down as the tilting movement is continued. During the rest of the tilting process the rounded surface of the hook-shaped pivot element "rolls along" the surface of the guide bar, which reduces the amount of force necessary to produce the tilting movement.

In an especially preferred construction, a limiting device is provided within the cover arrangement in order to limit the angle to which the cover can be tilted. In a first design the limiting device comprises the hook-shaped pivot element and the pivot peg. In this case the pivot element is so formed that the downwardly bent end of the element abuts against the underside of the pivot peg when the cover has been tilted to a predetermined limiting angle, so that continuation of the tilting movement is prevented.

In an alternative embodiment the limiting device comprises the hook-shaped pivot element and the edge of the frame. In this case the pivot element is constructed so that when the limiting angle is reached, the surface of the pivot element abuts against the inner surface of the frame edge and the tilting movement is thereby interrupted. In a preferred design the surface of the hook-shaped pivot element is flush with the upper surface of the cover, so that when the limiting angle has been reached, the surface of the pivot element as well as that of the cover abuts against the inner surface of the frame edge.

In an embodiment that combines the embodiments last described, the pivot element is constructed as follows: to ensure that tilting is stopped when the limiting angle is reached, the downwardly bent end of the pivot element abuts against the underside of the pivot peg, and at the same time the surface of the pivot element abuts, or the surfaces of both pivot element and cover abut, against the inner surface of the frame edge.

The limiting angle in a first embodiment is defined as the angle at which the cover always returns to the original resting position when no force is acting on it. The cover can be tilted upward just far enough to allow maintenance or cleaning work to be done on the channel arrangement, or cables to be laid. An advantage of this design resides in the fact that the channel arrangement cannot accidentally be left in the cover-tilted position. A cover arrangement in this embodiment is particularly preferred in regions with a high degree of public access, especially around schools or kindergartens. Thus a risk that someone will be injured at an unsupervised channel arrangement, in particular in the case of children at play, is minimized. In this embodiment the limiting angle is chosen to be smaller than 90°.

In another embodiment the limiting angle is specified as that at which the tilted cover retains its position without further application of force. An advantage of this embodiment lies in the fact that in order to carry out work within the channel arrangement, the cover is tilted as far as the limiting angle and thereafter remains open without being held in that position. As a result, work on the channel can be performed rapidly and cost-effectively. For this embodiment the limiting angle should be greater than 90°. In order to avoid the possibility of the cover being unintentionally pushed shut, for instance by gusts of wind or vibrations, the angle should preferably be 95–110°.

In an especially preferred design the downwardly bent region of the hook-shaped pivot element is curved substantially like the arc of a circle, such that when the cover has been completely put into place, the center of the circle of which the arc is a part coincides with the axis of rotation. As a result, the force that must be applied to tilt the cover is minimized and at the same time it is ensured that the rotational movement is uniform in the region of the hinge means. Preferably the downwardly bent end of the pivot element is rounded in such a way that the rotational movement of the cover is entirely continuous, with no downward or horizontal displacement of the cover.

The pivot peg is preferably so constructed that an outwardly pointing end has a substantially semicircular shape and the center of a circle that would complete the semicircle coincides with the axis of rotation. Hence during the rotational movement the pivot element and the pivot peg share as large an area as possible, thus maximizing a continuous rotational movement of the cover with no downward or horizontal displacement. A horizontally extending section of the pivot peg is preferably oriented parallel to a horizontally extending region of the hook-shaped pivot element.

In one preferred embodiment, when the cover is completely closed the hook-shaped pivot element and the pivot peg are spaced apart from one another, preferably by a distance in the range 1–5 mm. As a result, when the cover is fully in place only its feet are resting on the bearing surface of the frame. The forces acting on the bearing surface are therefore absorbed directly by the frame. The rotation and fixation devices are thus disposed in such a way that they need to support the forces associated with the weight of the tilted cover only during the process of tilting, with the result that much material is saved, and the cover arrangement can be manufactured very economically.

The frame and the cover can be made rectangular, in which case the pivot pegs are disposed on the face of the frame with respect to the axis of rotation, being attached either directly to the frame and/or by way of supporting elements fixed to the frame, so that the pegs are spaced apart from the edge of the frame. In another embodiment frame and cover are circular, in which case the pivot pegs are spaced apart from the edge of the frame by supporting elements fixed to the frame.

In one preferred embodiment the surface of the hook-shaped pivot element is guided along an inner surface of an outer edge of the frame as the rotational movement is being carried out. Because the surface of the pivot element is rounded, it "rolls along" this inner surface as the cover is being tilted. A substantial advantage of this embodiment resides in the fact that during tilting of the cover a horizontal displacement of the cover is prevented.

Preferably, the bearing surface is provided with a groove into which a damping element can be inserted, as a result of which the ability of the cover to support vehicular traffic is considerably improved. Furthermore, the damping element prevents the cover from rattling, as it might otherwise do owing to unevenness in the bearing surface or the penetration of dirt particles.

The frame, the guide bar and the pivot peg are formed in one piece, preferably of cast iron (e.g. gray casting). The cover and the pivot element are likewise integrally formed, preferably of cast iron. In the cover are provided openings that can engage an inserted tool, which is used to lift the cover to the desired place and to tilt it.

Additional preferred embodiments of the invention will be apparent from the subordinate claims and the following description of preferred embodiments. These are explained with reference to drawings, wherein

DETAILED DESCRIPTION OF THE INVENTION

Figure 1:
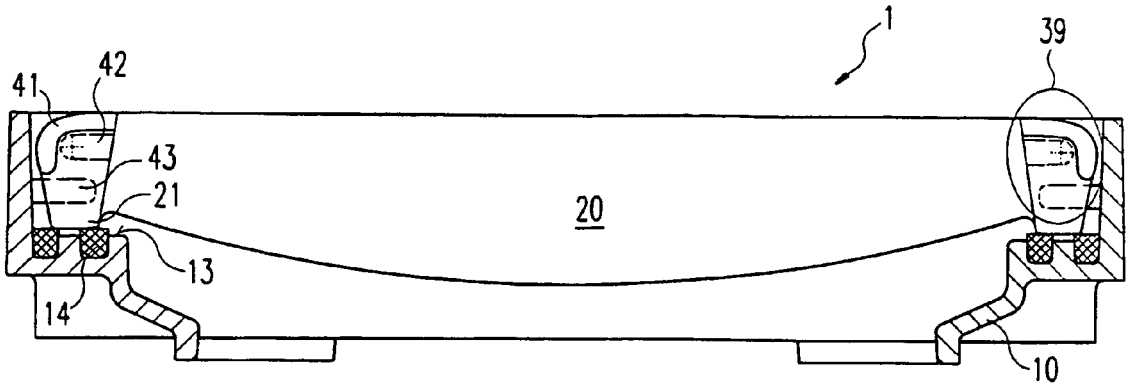
FIG. 1 shows a cross section through a cover arrangement with a cover set completely onto the arrangement.

In the following description, the same reference numerals are used for identical parts or parts with identical actions.

FIG. 1 shows a cross section through a cover arrangement 1, consisting of a frame 10 and a cover 20 placed so that it rests completely thereon. The lower part of the cover arrangement is so constructed that it can be set in a form-fitting manner onto a channel arrangement, drainage channel, cable channel, shaft or similar structure (not shown in the drawing) that can be installed in the ground and opened.

On opposite sides of the cover arrangement 1 are disposed hinge means, which consist of two first rotation/fixation devices 39. By way of the hinge means the cover 20 is pivoted toward two sides without the use of a tool. Each of the first rotation/fixation devices 39 comprises a downwardly bent, hook-shaped pivot element 41, a pivot peg 42 and a guide bar 43. The hook-shaped pivot element 41 is fixedly connected to the cover 20, the upper surface of the pivot element 41 preferably being flush with the upper surface of the cover 20. The pivot peg 42 is fixedly connected to the frame 10 and is shaped so as to correspond to the hook-shaped pivot element 41, so that the pivot element 41 can be rotated about the pivot peg 42. The pivot peg 42 is so disposed with respect to the axis of rotation that the pivot element 41 can be lifted away from the pivot peg 42 only when the cover 20 is completely seated, i.e. is in the state shown in the drawing. In this position a cover foot 21, which forms part of the cover, rests on two damping elements 14 that have been inserted into grooves in a bearing surface 13 of the frame. Between the pivot element 41 and the pivot peg 42 is provided a space of preferably 1–5 mm. In an advantageous design the frame 10, pivot peg 42 and guide bar 43 are formed integrally, preferably as a cast grid. The cover 20 and the hook-shaped pivot element 41 are likewise integral and preferably made as a cast grid. The cover 20, in particular when the cover arrangement 1 is intended for a drainage channel, is constructed as a grating provided with openings for the entry of water.

Figure 2:
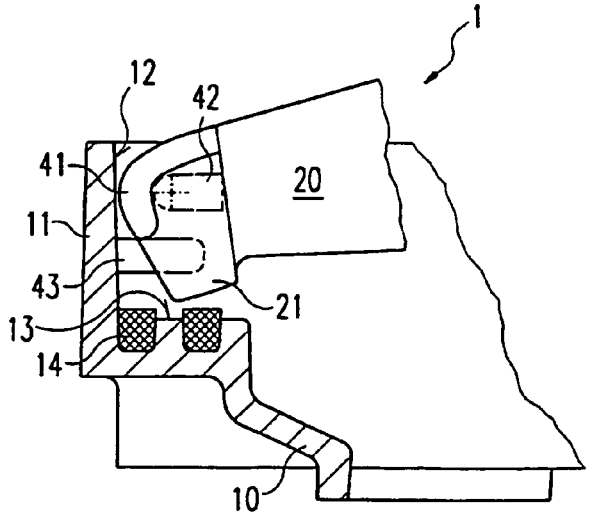
FIG. 2 shows a partial cross section through the cover arrangement with a partially tilted cover.

FIG. 2 shows a partial cross section of the cover arrangement 1, to illustrate the rotation/fixation device 39 on a larger scale. In this drawing of the arrangement the cover 20 is in a tilted state. The tilt angle is such that a downwardly bent end of the hook-shaped pivot element 41 comes into contact with the surface of the guide bar 43. The downwardly bent region of the hook-shaped pivot element 41 has substantially the shape of a circular arc, and an outwardly directed end of the pivot peg 42 is substantially hemispherical, so that there is a large area of contact between the pivot element 41 and the pivot peg 42, providing a form fitting. Therefore the rotational movement of the cover 20 occurs continuously, with no downward or horizontal displacement of the cover. When the cover 20 is tilted at the angle shown in the figure, furthermore, the cover foot 21 has been raised away from the damping elements 14 on the bearing surface 13. As a result, in this position a force directed vertically downward, associated with the weight of the cover 20, is transmitted by way of the pivot element 41 to the guide bar 43. A force directed horizontally outward is transmitted to an inner surface 12 of a frame edge 11, by way of the surface of the pivot element 41. This prevents horizontal displacement of the cover 20 when it is tilted.

Figure 3:
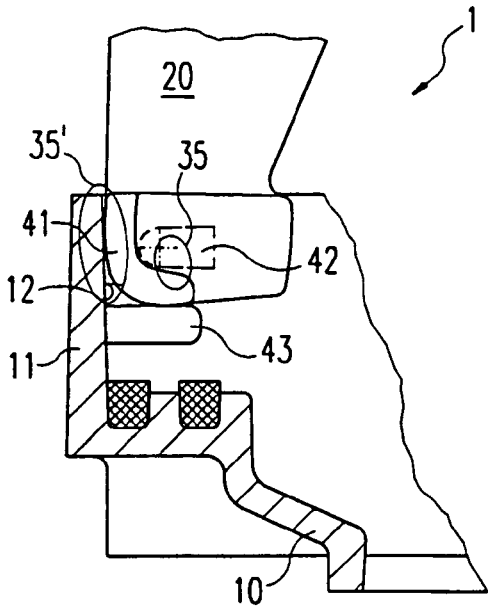
FIG. 3 shows a partial cross section through the cover arrangement with the cover tilted as far as a limiting angle.

FIG. 3 shows a partial cross section of the cover arrangement 1 like that in FIG. 2, but with the cover 20 tilted up to the limiting angle. The guide bar 43 is now below the hook-shaped pivot element 41, which during tilting of the cover 20 has been guided into that position by the form fitting between the pivot peg 42 and the guide bar 43. In addition, the surface of the pivot element 41 is guided along the inner surface 12 of the frame edge 11.

The cover arrangement 1 shown in the figure comprises two limiting mechanisms 35, 35'. A first limiting mechanism 35 comprises the hook-shaped pivot element 41 and the pivot peg 42. When the tilt angle is made equal to the limiting angle, the downwardly bent end of the pivot element 41 abuts against the underside of the pivot peg 42, which prevents any continuation of the rotational movement. A second limiting mechanism 35' comprises the pivot element 41 and the frame edge 11. When the tilt angle equals the limiting angle, the surface of the pivot element 41 abuts against the inner surface 12, likewise interrupting the rotational movement. The angle of the inner surface 12 with respect to the horizontal is the same as the limiting angle. The limiting angle chosen here is such that when tilted to this angle, the cover 20 stays in position even in the absence of any retaining force. The specification for this limiting angle is that the center of gravity of the cover 20 is within a region to the left of a vertical line through the axis of rotation.

A cover arrangement not shown in the figures contains only the first limiting mechanism 35 or the second limiting mechanism 35'.

Figure 4:
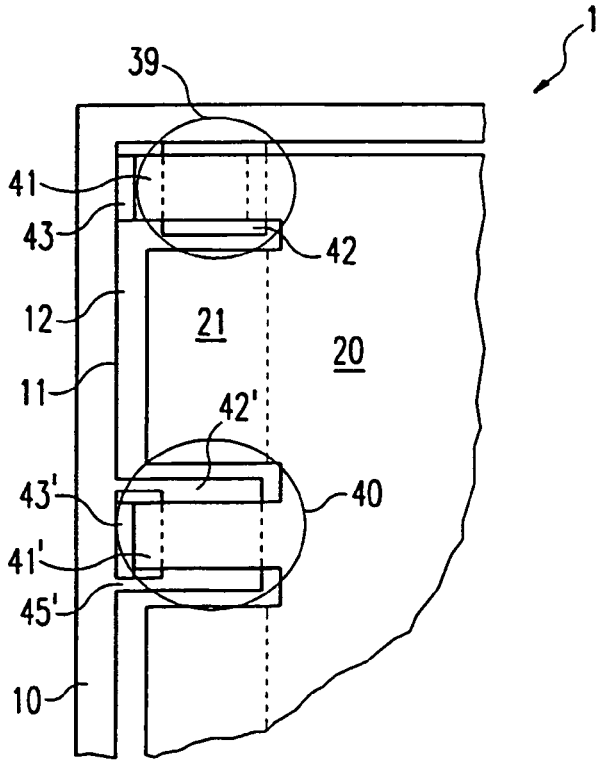
FIG. 4 shows a plan view of a rectangular channel arrangement.

FIG. 4 is a plan view of a rectangular cover arrangement 1. The cover 20 is connected to the frame 10 by way of rotation/fixation devices 39 and 40. The pivot peg 42 of the first rotation/fixation device 39 is disposed at the end of the axis of rotation, being attached directly to the frame. The pivot peg 42' of the second rotation/fixation device 40 is attached by means of at least one supporting element 45, so as to be spaced apart from the frame 10. The supporting element 45 is disposed horizontally in the design shown in the figure, and is fixedly attached to the frame edge 11. In another design, not shown in the figure, the supporting element 45 is disposed vertically and fixedly attached to the inner surface 12. In both embodiments the pivot peg 42' is held at at least one of its ends by the supporting element 45.

Figure 5:
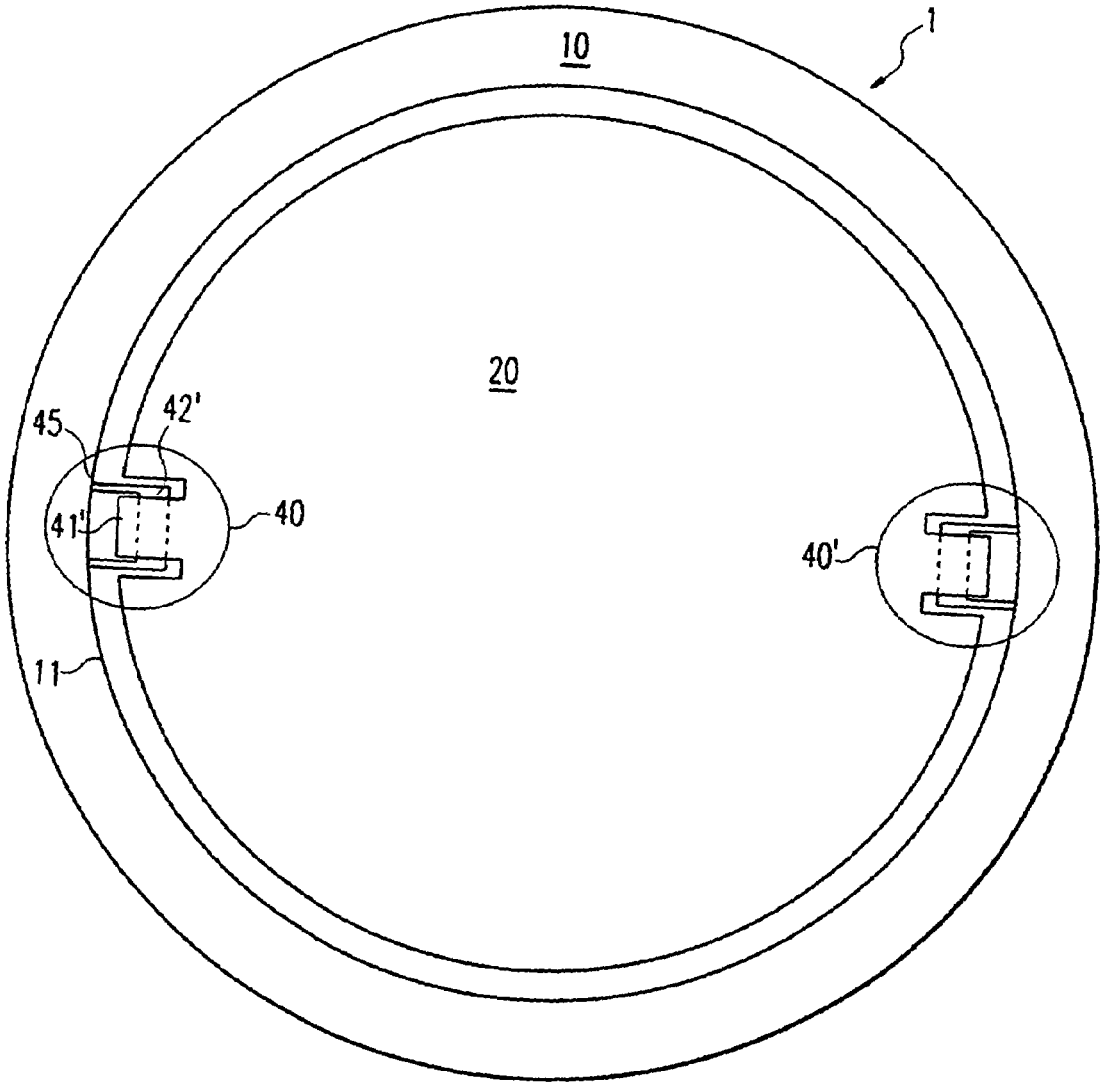
FIG. 5 shows a plan view of a circular channel arrangement.

In FIG. 5 is shown a plan view of a cover arrangement 1 in the form of a circle. In this embodiment the cover 20 is connected to the frame 10 by way of the second rotation/fixation devices 39 and 40. In another design, not shown in the figure, the cover is connected to the frame 10 by means of four rotation/fixation devices disposed at 90° angles. In this design the cover can be tilted in four directions.

At this juncture it should be pointed out that all the parts described above, individually or in combination, in particular the details shown in the drawings, are claimed as essential to the invention. Modifications thereof are familiar to those skilled in the art.

| List of reference numerals | |
|---|---|
| 1 | Cover arrangement |
| 10 | Frame |
| 11 | Frame edge |
| 12 | Inner surface |
| 13 | Bearing surface |
| 14 | Damping element |
| 20 | Cover |
| 21 | Cover foot |
| 35, 35' | Limiting mechanism |
| 39 | First rotation/fixation device |
| 40, 40' | Second rotation/fixation device |
| 41, 41' | Hook-shaped pivot element |

-continued

| List of reference numerals | |
|---|---|
| 42, 42' | Pivot peg |
| 43, 43' | Guide bar |
| 45 | Supporting element |

The invention claimed is:

1. Cover arrangement for a channel arrangement that can be installed in the ground and opened, comprising a cover, and a frame defining a bearing surface, wherein the cover can be set on the bearing surface and coupled to the frame so as to be pivotable about an axis of rotation, the cover being tiltable toward two sides without the use of tools, by two oppositely disposed hinges each comprising a rotation and fixation device, wherein the hinges are configured so that the cover is liftable vertically upward, thus disengaging the rotation and fixation devices without tilting movement of the cover with respect to the frame, wherein each rotation and fixation device comprises:

a downwardly bent, hook-shaped pivot element connected to the cover, a pivot peg connected to the frame and shaped to correspond with the pivot element, about which the pivot element can be rotated, and which is disposed with respect to the axis of rotation in such a way that when the cover is in a completely closed position, the pivot element can be lifted away from the pivot peg;

a guide bar disposed below the pivot peg such that during the tilting movement of the cover, the hook-shaped pivot element is guided between the pivot peg and the guide bar in a form-fitting manner, wherein the guide bar and the pivot peg are constructed and disposed such that during the rotational movement made by the cover due to lifting of the opposite side of the cover, a downwardly bent end of the pivot element comes into contact with the upper surface of the guide bar when a first tilt angle between 10° to 20° is reached, and simultaneously a bearing surface of a cover foot is raised away from the bearing surface of the frame.

2. Cover arrangement according to claim 1, wherein a limiting mechanism is provided to limit the tilt angle.

3. Cover arrangement according to claim 1, wherein the downwardly bent region of the hook-shaped pivot element is bent downward in substantially the shape of an arc of a circle, such that when the cover is in the completely closed state, wherein the center of a full circle to complete the arc coincides with the axis of rotation.

4. Cover arrangement according to claim 1, wherein the downwardly bent end of the hook-shaped pivot element is rounded in such a way that the rotational movement of the cover is continuous, with no downward or horizontal displacement of the cover.

5. Cover arrangement according to claim 1, wherein an outwardly directed end of the pivot peg is constructed in a substantially semicircular shape and the center of a full circle to complete the semicircle coincides with the axis of rotation.

6. Cover arrangement according to claim 1, wherein the pivot peg comprises a horizontally extending section oriented parallel to a horizontally extending region of the hook-shaped pivot element.

7. Cover arrangement according to claim 1, wherein the hook-shaped pivot element and the pivot peg are spaced apart from one another by a distance in the range from 1 to 5 mm when the cover is in the completely closed state.

8. Cover arrangement according to claim 1, wherein the frame and the cover are rectangular, and the pivot peg is attached to a frame edge at one end of the axis of rotation.

9. Cover arrangement according to claim 1, wherein the frame and the cover are constructed in a circular shape, the pivot peg being connected so as to be spaced apart from the frame edge by way of at least one supporting element that is attached to the frame.

10. Cover arrangement according to claim 1, wherein during the tilting movement, the surface of the hook-shaped pivot element is guided along an inner surface of the frame edge.

11. Cover arrangement according to claim 2, wherein the limiting mechanism comprises the hook-shaped pivot element and the pivot peg, the pivot element being so constructed that the downwardly bent end thereof abuts against the underside of the pivot peg when a limiting angle is reached, thus preventing continuation of the rotational movement.

12. Cover arrangement according to claim 2, wherein the limiting mechanism comprises the hook-shaped pivot element and an inner surface of the frame edge, such that the surface of the pivot element abuts against the inner surface when a limiting angle is reached, thus preventing continuation of the rotational movement.

13. Cover arrangement according to claim 12, wherein the surface of the hook-shaped pivot element is flush with the upper surface of the cover, such that the surfaces of the pivot element and the cover abut against the inner surface when a limiting angle is reached, thus preventing continuation of the rotational movement.

14. Cover arrangement according claim 12, wherein the inner surface is set at a predetermined angle with respect to the horizontal, wherein the predetermined angle is equal to the limiting angle and is determined such that when the cover has been tilted to the predetermined angle, no further force must be applied to keep the cover in that position.

15. Cover arrangement according to claim 1, wherein the bearing surface comprises at least one damping element on which a cover foot rests.

16. Cover arrangement according to claim 1, wherein the frame, the guide bar and the pivot peg are formed in one piece.

17. Cover arrangement according to claim 1, wherein a side of the cover defines an engagement opening for the insertion of a tool to raise the cover in order to be tilted.

18. Cover arrangement according to claim 5, wherein the frame and the cover are rectangular, and the pivot peg is connected to a frame edge at one end of the axis of rotation so as to be spaced apart from the frame edge by way of at least one supporting element that is attached to the frame.

* * * * *